US005426792A

United States Patent [19]

Murasko

[11] Patent Number: 5,426,792

[45] Date of Patent: Jun. 27, 1995

[54] ELECTROLUMINESCENT AND LIGHT REFLECTIVE HELMET

[76] Inventor: Matthew M. Murasko, 408 Marine Ave., Manhattan Beach, Calif. 90266

[21] Appl. No.: 215,390

[22] Filed: Mar. 21, 1994

Related U.S. Application Data

[63] Continuation-in-part of Ser. No. 92,256, Jul. 15, 1993, abandoned.

[51] Int. Cl.[6] ..... A42B 3/02; F21L 15/14

[52] U.S. Cl. ..... 2/422; 2/906; 362/105

[58] Field of Search ..... 2/422, 410, 425, 905, 2/906; 362/105, 106, 103

[56] References Cited

U.S. PATENT DOCUMENTS

| | | | |
|---|---|---|---|
| D. 310,434 | 9/1990 | Breece . | |
| D. 326,924 | 6/1992 | Carroll . | |
| 3,317,722 | 5/1967 | Whitney . | |
| 3,358,137 | 12/1967 | Sinclair et al. | 362/106 |
| 3,793,517 | 2/1974 | Carlini . | |
| 4,090,232 | 5/1978 | Golden | 362/105 X |
| 4,195,328 | 3/1980 | Harris, Jr. . | |
| 4,234,907 | 11/1980 | Daniel . | |
| 4,319,308 | 3/1982 | Ippoliti . | |
| 4,480,293 | 10/1984 | Wells . | |
| 4,559,586 | 12/1985 | Slarve | 362/106 |
| 4,570,206 | 2/1986 | Deutsch . | |
| 4,652,981 | 3/1987 | Glynn . | |
| 4,667,274 | 5/1987 | Daniel . | |
| 4,709,307 | 11/1987 | Branom . | |
| 4,862,331 | 8/1989 | Hanabusa . | |
| 4,875,144 | 10/1989 | Wainwright . | |
| 4,891,736 | 1/1990 | Gouda | 362/105 |
| 4,893,356 | 1/1990 | Waters | 2/422 X |
| 4,901,211 | 2/1990 | Shen . | |
| 4,945,458 | 7/1990 | Batts et al. . | |
| 4,956,752 | 9/1990 | Foglietti . | |
| 4,999,936 | 3/1991 | Calamia et al. . | |
| 5,019,438 | 5/1991 | Rapisarda . | |
| 5,040,099 | 8/1991 | Harris . | |
| 5,067,063 | 11/1991 | Granneman et al. . | |
| 5,111,366 | 5/1992 | Rife et al. . | |
| 5,128,844 | 7/1992 | Landais | 362/105 |
| 5,138,539 | 8/1992 | Honda et al. . | |
| 5,151,678 | 9/1992 | Veltri et al. | 362/103 X |

FOREIGN PATENT DOCUMENTS

| | | | |
|---|---|---|---|
| 0166534 | 1/1986 | European Pat. Off. | 362/105 |
| 1401264 | 4/1965 | France | 362/106 |
| 3042159 | 6/1982 | Germany | 2/422 |
| 2107039 | 4/1983 | United Kingdom | 362/106 |

*Primary Examiner*—Peter Nerbun
*Attorney, Agent, or Firm*—Fulwider Patton Lee & Utecht

[57] ABSTRACT

An illuminated safety helmet incorporating a light panel that is capable of producing electroluminescence, and also, reflecting incident light that is independent of the electroluminescence function of the panel. The light panel is secured to the helmet so as to be visible to an observer, and a power source is secured to the helmet so as not to interfere with the wearing of the helmet. The power source is connected to the light panel, and a control switch may be provided to control the power directed from the power source to the light panel.

12 Claims, 6 Drawing Sheets

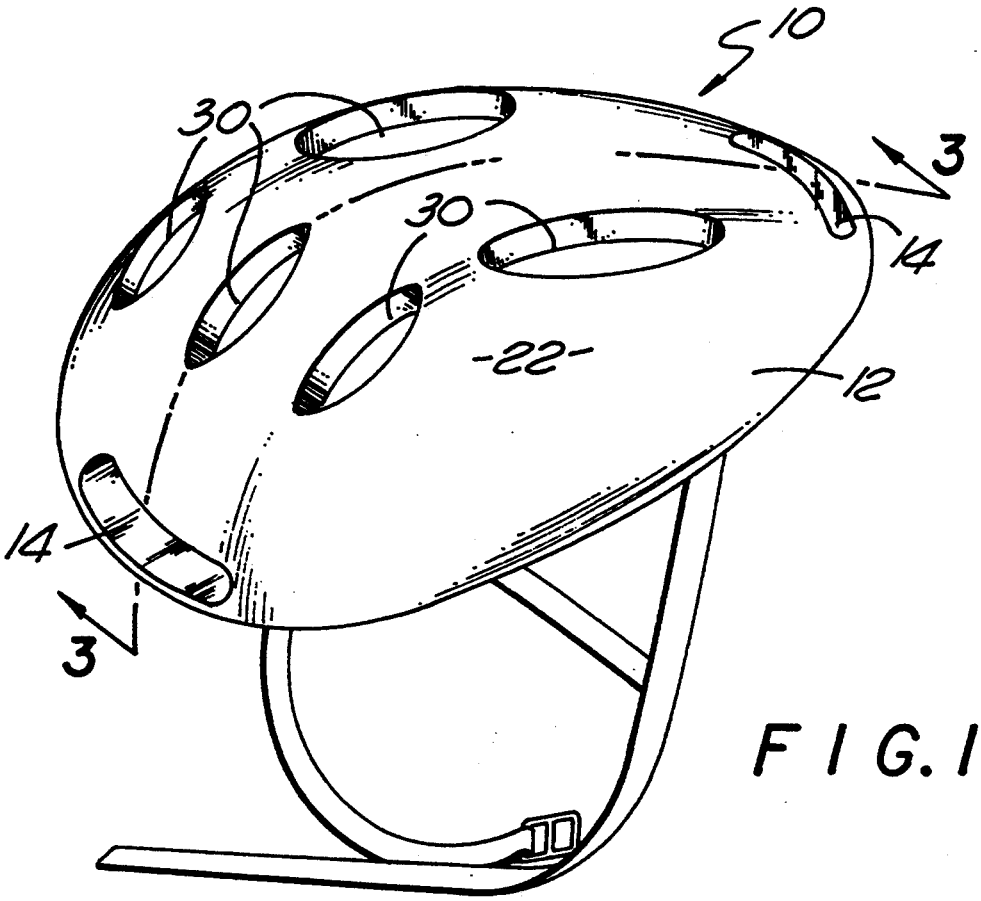
FIG. 1
FIG. 2
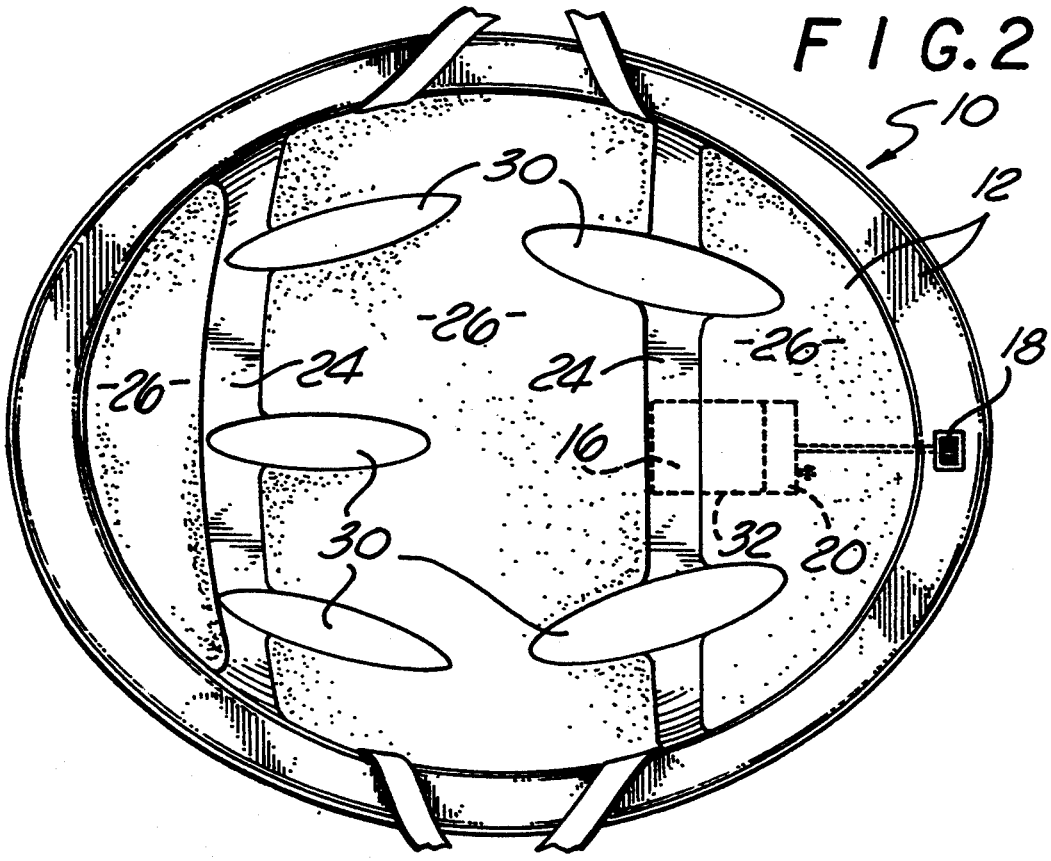

ELECTROLUMINESCENT AND LIGHT REFLECTIVE HELMET

This application is a continuation-in-part, of application Ser. No. 08/092,256, filed Jul. 15, 1993, now abandoned.

BACKGROUND OF THE INVENTION

1. Field of the Invention

This invention generally relates to helmets and protective headgear, and more specifically, to headgear incorporating electroluminescent light emitting panels and reflective strips for enhancing visibility, safety, recognition, and appearance.

2. Description of Related Art

Helmets are increasingly being used by sports and outdoors enthusiasts and those with professions that carry some risk of injury to the head. For example, bicycle riders, motorcycle riders, skaters, fire fighters, mountain climbers, and construction workers are often required to wear helmets to protect their heads from injury. In case of an accident, the design and quality of a helmet's construction play important roles in preventing serious injury. Perhaps equally as important to protection is the need for prevention of accidents, and in this regard the visibility of the helmet from a distance provides added protection for the wearer. In addition to enhancing safety, helmets may be provided with the capability to display information or a design logo to thereby create an advertising and marketing tool.

In the past, various attempts have been made at providing helmets with a capability to emit or reflect light. Typically, such attempts have included adding or incorporating individual sources of light such as incandescent bulbs, light emitting diodes (LEDs), or light reflective strips into helmets.

However, there are several drawbacks associated with existing light sources that are incorporated into helmets. For example, incandescent light bulbs and LEDs are typically bulky and relatively heavy for their light emitting power. The bulkiness of such light sources also often causes the light source to protrude from the surface of the helmet, or require an overall increase in the size of the helmet, which places negative effects on the aerodynamics of helmets that are used in activities in which the wearer moves with speed. Existing illuminated helmets typically require holes, sockets, straps, fasteners, and other hardware to secure the light source to the helmet, which makes such attachment cumbersome, and adds a relatively large amount of weight to the helmet, thereby increasing the wearer's discomfort. Also, the hardware and attachment methods used to secure the light source to the helmet have poor durability as they can be easily damaged or broken. Further, conventional light sources that are used on helmets are prone to failure as they typically are not shockproof or waterproof.

In addition, incandescent light bulbs and LEDs produce heat which may cause discomfort to the wearer, and LEDs may not provide adequate visibility in bad weather conditions such as rain, snow, and fog. Similarly, light reflective strips that are attached to helmets are only partially effective, when used alone, as they depend on outside light sources for providing illumination. Furthermore, existing light sources that are used on safety helmets do not lend themselves to being conformable into various figures or patterns such as design logos or written material for easy attachment to a helmet. Typically, conventional helmets or caps upon which an illuminated logo or design is to be displayed require that a logo be stencilled or otherwise printed on the panel, which is then placed over a light source to illuminate the logo. Such methods of creating an illuminated logo or icon greatly reduce the functionality of existing light sources for use on helmets.

What has been needed and heretofore unavailable is a helmet incorporating an inexpensive, durable, reliable, light-weight, thin, and relatively small illumination system that is capable of producing highly visible cool light, and also includes light reflective qualities. Such an illumination system must be flexible and capable of easy attachment to the helmet to exhibit light in various shapes and forms without the need for a background light source. The present invention fulfills this need.

SUMMARY OF THE INVENTION

The present invention is directed to a helmet with an illumination system which can emit electroluminescent light, and in addition, may reflect incident light received from an outside light source. The illuminated helmet of the invention provides a cool light source (with an available reflective capability) that is thin, light-weight, durable, flexible, conformable to many shapes and sizes, and easily attachable to the helmet.

In accordance with the present invention, an electroluminescent panel is secured to or incorporated into the outer surface of a helmet so that it can be visible to an observer. The electroluminescent panel used in the invention (also known as electroluminescent lamp or tape) is a surface-area light source wherein light is produced by causing the excitation of a suitable phosphor placed between two metallic laminated sheet surfaces forming the front and rear electrode layers, the front electrode layer being essentially transparent. One example of an external source of excitation is an alternating current power source which provides a sufficiently high voltage and frequency rating. For this purpose, a DC (direct current) power supply such as a battery having a specific voltage is connected to an inverter which converts DC to AC (alternating current) power while boosting the voltage and the frequency rating. The AC power is directed to the laminated panel via electrical leads connected between the inverter and the front and rear electrode layers. A control switch (e.g., an ON/OFF switch, a dimmer switch, etc.), electrically connected between the DC power supply and the DC to AC inverter, is used to activate the electrode layers which in turn generate an electric field around the phosphor layer, thereby causing the excitation and illumination of the phosphor.

In the present invention, the electroluminescent panel can be secured to the outside surface of a typical helmet with one or more layers of protective material, or incorporated therein so as to be visible to an outside observer. In single-layer helmets (e.g., bicycle helmets made of a thick rigid layer of styrofoam), the power source and the inverter can be embedded in a cavity created in the layer of protective material so as not to come in contact with the head of the wearer. In multilayer helmets (e.g., motorcycle helmets having a tough rigid outer layer and a relatively softer inner layer with a space therebetween), the power source and the inverter can be placed in the space between the layers of material, or can be embedded in one or more of the layers of material. In either case, leads are directed from the power source to the switch (conveniently located on the helmet so as to be accessible to the wearer), continuing to the inverter and then directed for connection to the electrode layers of the electroluminescent panel. As an alternative, the power source, the inverter, and the control switch may be placed in a convenient package that can be kept close to the helmet and carried by the wearer or secured to the outside of the helmet as an add-on accessory.

In the event of impact on the helmet by an outside force, it may be desirable to reduce the risk of injury to the head of the wearer caused by the compression of the power source, the inverter, and the control switch against the wearer's head. Therefore, in both single-layer and multi-layer helmets, these components may be placed behind retention walls with large surface areas that will help to distribute the impact over a greater area. In other words, the placement of the components within the helmet behind retention walls will reduce the force of the impact and the transmission thereof per unit area of the wearer's head.

Furthermore, in order to meet the safety standards set out by various helmet testing authorities (e.g., the Snell Memorial Foundation Standards), the positioning of the components and the retention walls within the helmet may be altered. Accordingly, instead of placing the components and the retention walls above the head of the wearer, they may be placed in the lower portion of safety helmets and below the "test line" as defined by the Snell Memorial Foundation Standards.

In addition to having a helmet with electroluminescent capabilities, the panel used in the present invention can be modified to include a reflective capability in response to incident light emitted from an outside light source. Accordingly, a transparent reflective film layer can be disposed on top of the transparent front electrode layer, thereby providing a desirable reflective characteristic to the illumination panel without any interference with its electroluminescence feature. The reflective function is activated whenever incident light reaches the panel from an outside light source. Therefore, the panel is capable of serving an important dual purpose; i.e., on-demand illumination by excitation of the phosphor layer, or reflection of incident light from an outside light source independent of the phosphor illumination. Since this added reflective capability does not interfere with the electroluminescence of the panel, it would greatly enhance its functionality, because regardless of whether the panel is in the ON or OFF mode (or even if the power supply is drained), the panel would be visible when an outside source (e.g., automobile headlights, flashlight) imparts light thereon.

In conventional electroluminescent panels, the entire laminated structure is typically sealed by a protective material (e.g., ACLAR TM) that is impervious to moisture or other outside influences that may interfere with its operation. ACLAR TM is an expensive material which in turn increases the cost of the panel and limits the freedom of design. Alternatively, in recently-designed electroluminescent panels the phosphor particles can be microencapsulated according to a process which is used in a commercially available electroluminescent panel known as the QUANTAFLEX 1400 TM sold by MKS, Inc. of Bridgeton, N.J. This microencapsulation process makes the panel highly resistant to thermal shock and cycling. It eliminates the need for a protective coating around the panel, and allows the panel to emit light over its entire surface, including the edges. Also, the microencapsulation process results in a breathable panel which allows moisture to enter and exit with no obvious negative effects on performance. In addition, the microencapsulation process allows the phosphor particles to be selectively placed (preferably by screen printing it on a substrate) to create a logo or icon which can emit light. As compared to conventional methods of making electroluminescent panels which deposit phosphor over standard patterns such as rectangles and squares, this encapsulation method allows the direct surface area of a desired logo or icon to be illuminated, thereby saving valuable battery life and reducing power consumption.

By using an electroluminescent panel in the helmet of the present invention, the helmet is provided with a highly visible source of uniform light in various bright colors the choice of which is only limited by the choice of the particular phosphor used in the light panel. Such a panel has the ability to emit cool light without creating noticeable heat or substantial current drain as well as the ability to reflect incident light directed on the helmet. Such features improve safety by wearing a highly visible helmet that can attract viewers' attention. In addition, the electroluminescent panel in the present invention provides a means for creating an advertising medium for use on helmets to promote brand awareness by forming the panel in the shape of a design logo or other recognizable shape. As a decorative or novelty item, the light panel used in the invention can also improve the appearance of helmets. Furthermore, the illumination system of the present invention can be easily and inexpensively implemented therein during the manufacturing process. From the above, it may be seen that the present invention provides important advantages over existing illuminated helmets known in the art. Other features and advantages of the invention will become more apparent from the following detailed description and drawings which will illustrate, by way of example, the features of the invention.

BRIEF DESCRIPTION OF THE DRAWINGS

FIG. 1 is a perspective view of an illuminated safety helmet with a single layer protective material embodying features of the invention.

FIG. 2 is a bottom plan view of the illuminated safety helmet shown in FIG. 1.

Figure 5:
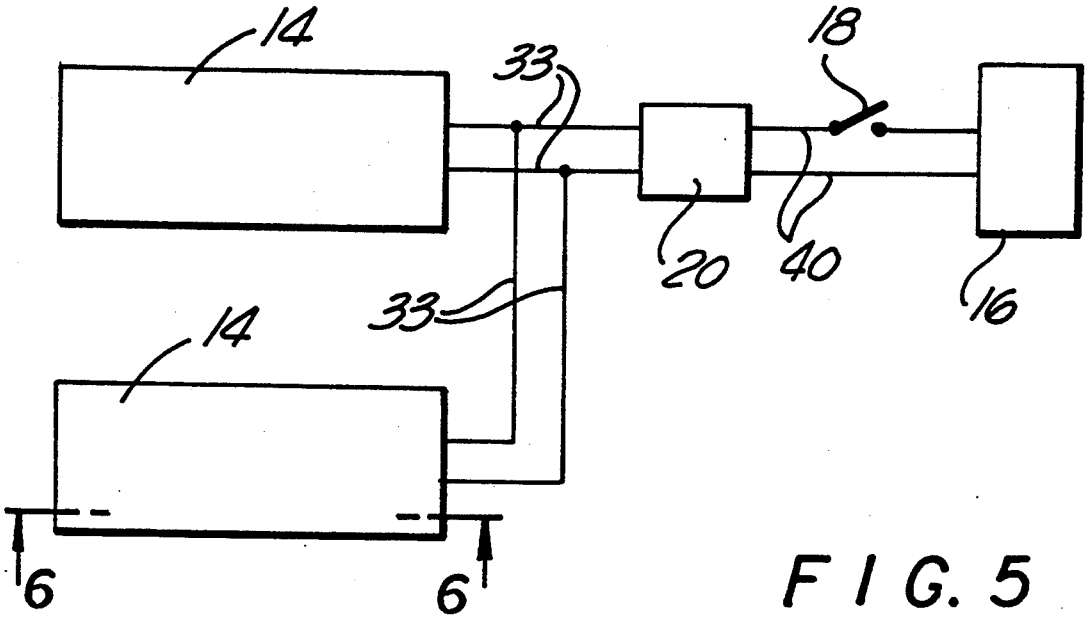
FIG. 5 is a block diagram of the illumination system of the illuminated safety helmet shown in FIGS. 1–4.

FIG. **6*a* is a cross-sectional view of the illumination panel of the illumination system shown in FIG. 5, taken along lines 6—6**, wherein the panel has electroluminescent (without reflective) capabilities.

FIG. **6*b* is a cross-sectional view of the illumination panel of the illumination system shown in FIG. 5, taken along lines 6—6**, wherein the panel has electroluminescent and reflective capabilities.

Figure 7:
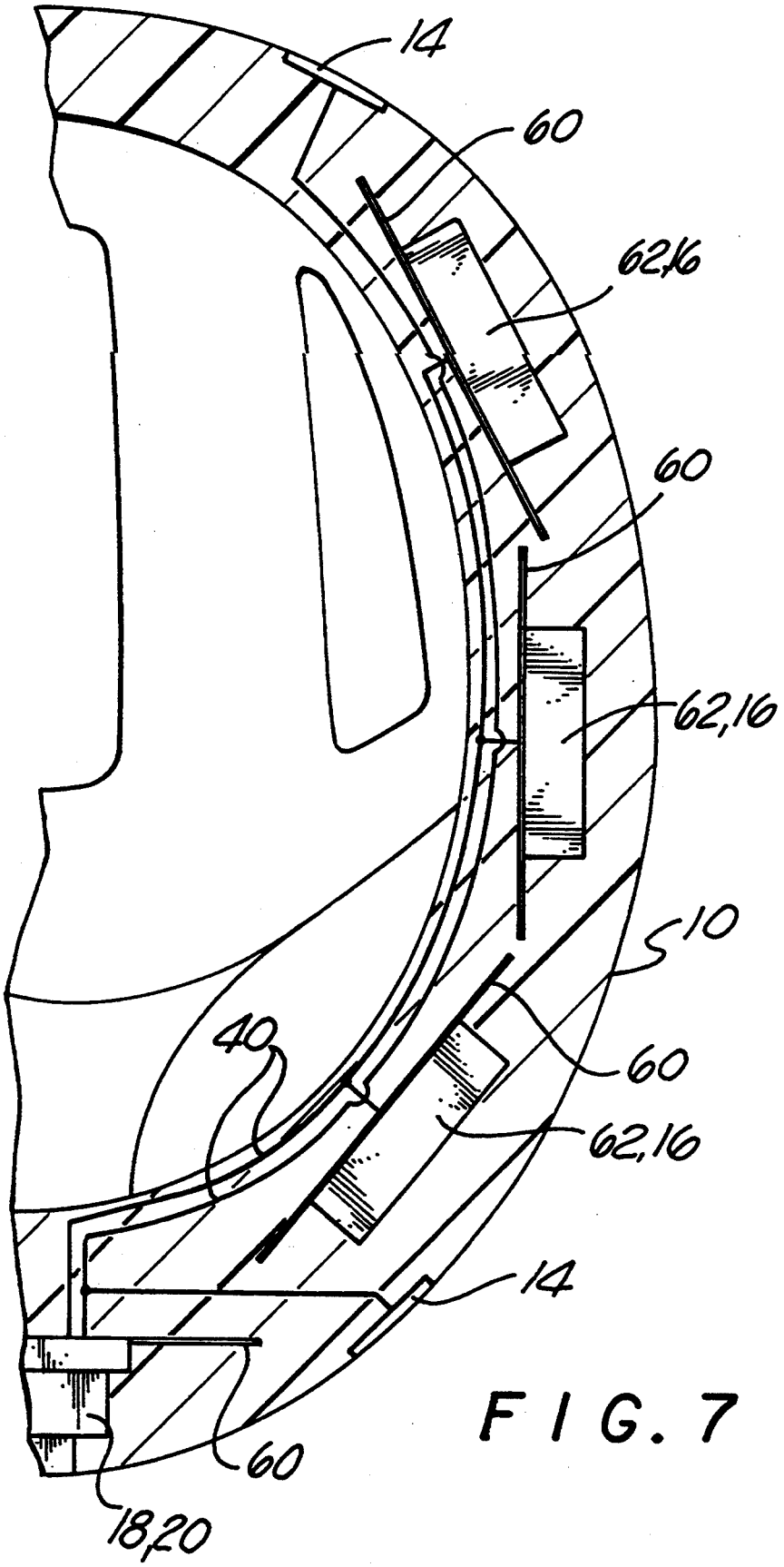

FIG. 7 is a cross-sectional side view of a second alternative embodiment of the illuminated safety helmet shown in FIG. 1, wherein the power source, the control switch, and the inverter are placed inside the protective material of the helmet behind retention walls.

Figure 8:
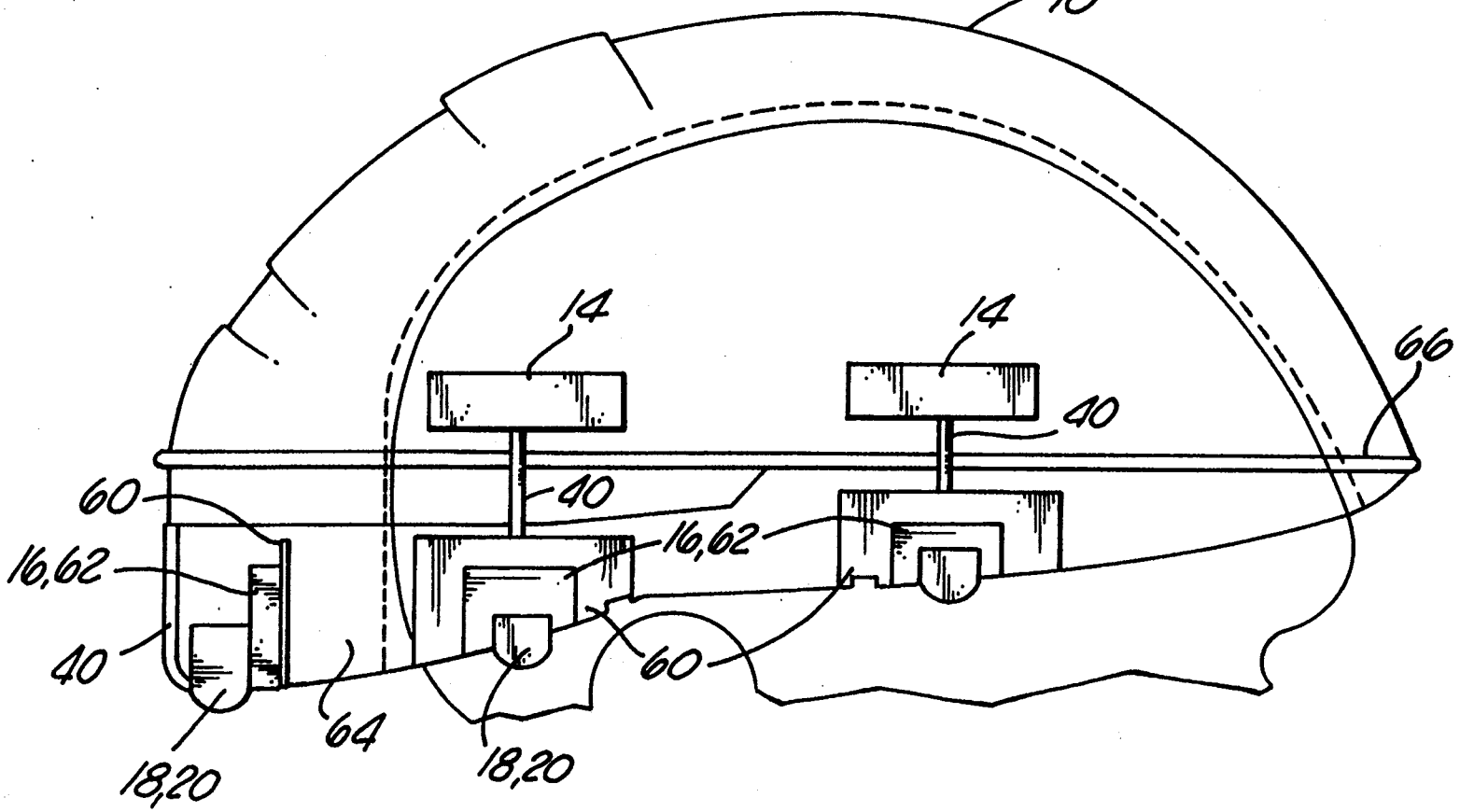

FIG. 8 is a cross-sectional side view of a third alternative embodiment of the illuminated safety helmet shown in FIG. 1, wherein the power source, the control switch, and the inverter are placed below the safety test line of the helmet behind retention walls.

Figure 9:
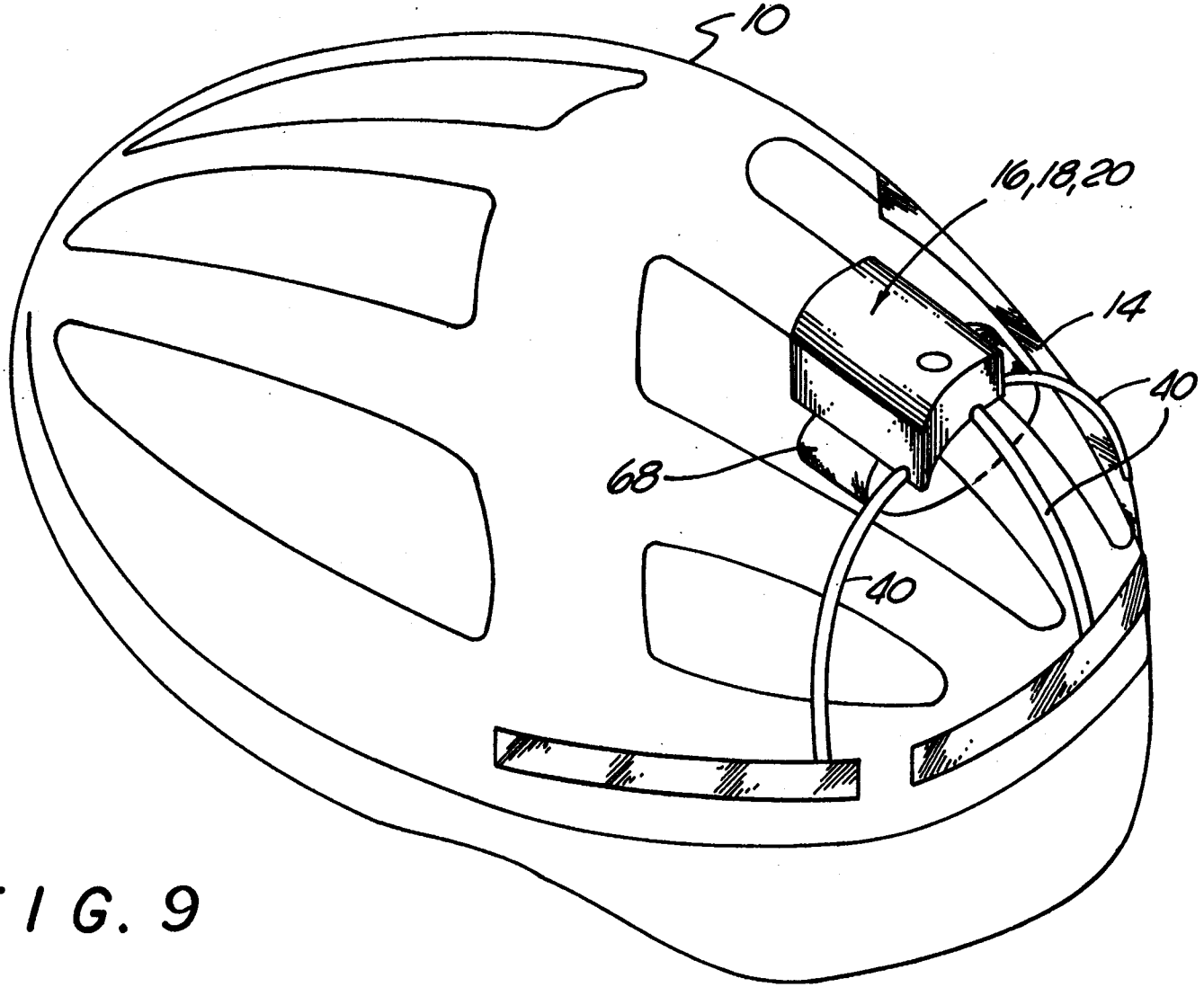

FIG. 9 is a perspective view of a fourth alternative embodiment of the illuminated safety helmet shown in FIG. 1, wherein the power source, the control switch, and the inverter can be fixed onto the exterior of the safety helmet as an add-on accessory.

DETAILED DESCRIPTION OF THE PREFERRED EMBODIMENTS

Figure 3:
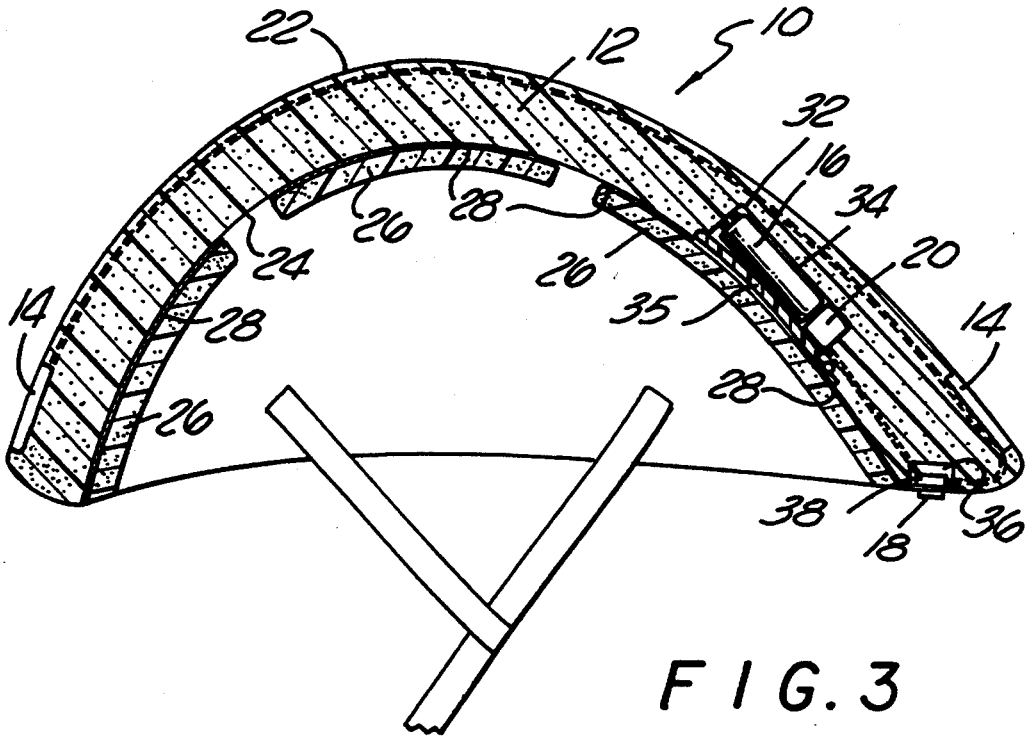
FIG. 3 is a cross-sectional view of the illuminated safety helmet shown in FIG. 1, taken along lines 3—3.
Figure 4:
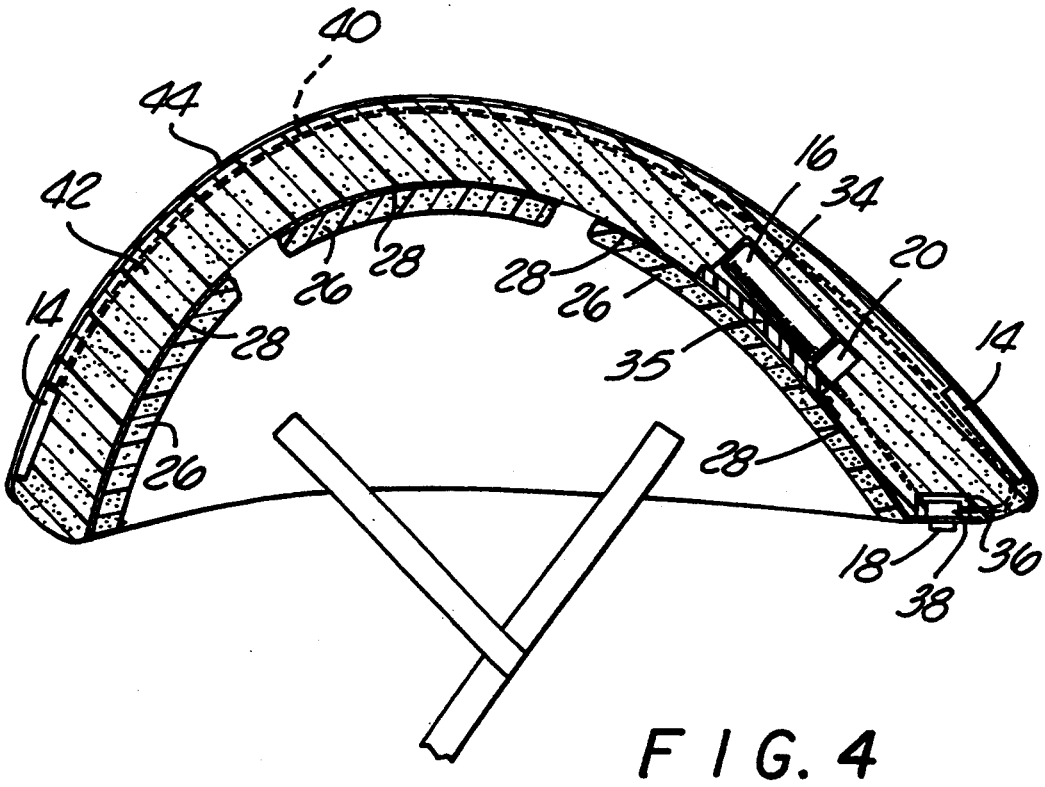
FIG. 4 is a cross-sectional view of an alternative embodiment of the illuminated safety helmet shown in FIG. 1, wherein the helmet has two layers of protective material.

FIGS. 1–3 illustrate a safety helmet with an illumination system that is capable of producing electroluminescent light as well as reflecting oncoming light from an outside source without interfering with the electroluminescent function of the system. Referring to FIGS. 1–3, the illuminated safety helmet 10 of the present invention includes a single protective layer 12 (a multi-layer helmet is also shown in FIG. 4 and described below), illumination panel 14, a power source 16, a control switch 18, and an inverter 20.

Protective layer 12 has an exterior surface 22 and an interior surface 24 which substantially conforms to the head of the wearer. If desired, soft foam pads 26 may be attached by fastener 28 (e.g., VELCRO) to interior surface 24 for the wearer's comfort. Protective layer 12 is typically made from a rigid material such as styrofoam or other light-weight but strong material that can protect the head of the wearer in case of impact with another object. The thickness of the protective layer of helmets may vary depending on the material chosen and the type of activity that it is intended for. Typically, protective layer 12 may include one or more slots 30 for cooling of the head and at the same time reducing the weight of the helmet without taking away from the structural integrity of the helmet.

As shown in FIGS. 2 and 3, a cavity portion 32 can be created in protective layer 12 so as to contain first housing 34 appropriately sized to hold power source 16 and inverter 20. Alternatively (not shown), separate cavity portions may be created to hold power source 16 and inverter 20. Cavity portion 32 is preferably molded into protective layer 12 during its formation, or alternatively may be created after the protective layer has been formed. First housing 34 may be made of plastic with a hinged door 35 to provide access thereto.

Control switch 18 is preferably located within a second housing 36 located towards the back of helmet 10 with the control arm or button 38 of switch 18 protruding through the surface of the helmet so that it can be actuated when the helmet is on the head of the wearer.

Illumination panel 14 may be placed on or near exterior surface 22 of helmet 10 so as to be visible to an outside observer from one or more directions (FIGS. 1 and 3–5 show two illumination panels, but any number may be used). Illumination panel 14 may be secured to helmet 10 by suitable means such as using a sufficiently strong and compatible adhesive such as the commercially available Spray Mount Artist's Adhesive (I.D. No. 62-4953-4825-2) or Super 77 Spray Adhesive (I.D. No. 62-4437-4930-4), both manufactured by the Minnesota Manufacturing and Mining (3M) Company. As shown in FIG. 5 and further described below, control switch 18 is electrically connected via wire leads 40 between power source 16 and inverter 20, while the output of inverter 20 is connected to panel 14. Wire leads 33 are preferably placed in grooves (not shown) that are created in protective layer 12, with leads 33 directed to reach illumination panel 14.

FIG. 4 illustrates a two-layer safety helmet, wherein an inner protective layer 42 is shaped to conform to the head of the wearer and an outer protective layer 44 is shaped to enclose the inner layer with a space therebetween. Inner and outer layers 42 and 44 typically are connected by appropriate fasteners and other connection methods. In such a multi-layer safety helmet, wire leads 40 may be placed in the space between the inner and outer layers, or may be located in grooves created in inner protective layer 42. As in single-layer helmets shown in FIGS. 1—3, power source 16 and inverter 20 may be similarly placed in first housing 34, and control switch 18 may be placed in second housing 36, with first and second housings 34 and 36 created in inner protective layer 42. Illumination panel 14 may be placed on or near the exterior surface of outer layer 44. Alternatively (not shown), panel 14 may be placed below exterior surface of outer layer 44, provided that the portion of outer layer 44 covering panel 14 is transparent so as to allow the luminescence to be visible. As another alternative (not shown), the power source, the inverter, and the control switch may be placed in a convenient package that can be kept close to the helmet and carried by the wearer.

FIG. 7 shows another alternative embodiment of the invention which attempts to reduce the risk of injury to the head of the wearer as a result of a possible impact with an outside force. If the power source, the inverter, or the switch are located within the helmet above the wearer's head, the concern in such a situation may be that the force of the impact may direct these components towards the head, to thereby cause injury or great discomfort to the wearer. In this embodiment, a retention wall 60 (preferably made of a sufficiently strong plastic) is placed next to these components. Each retention wall 60 is designed with a surface area greater than the surface area of the component that is facing the wearer. As a result, when impact occurs, the force of the impact on each component is distributed over a larger surface area before it is transmitted to the head of the wearer. The reduction of the force per unit area advantageously provides an added measure of safety to the wearer. It must be noted that in FIG. 6, three alternative locations are shown for power source 16 which can be DC batteries (e.g., N, AA, AAA, or flat coin cell batteries). Power source 16 is preferably placed in a case 62 (preferably made of plastic) which can be opened and closed for placing or replacing the power source therein. Also, by molding the case and its retention wall as one unit, and the inverter and control switch and their retention wall as another unit, they can be designed for easy placement within a cavity in the helmet. This should make the manufacturing process easier as well as reduce manufacturing cost.

FIG. 8 shows another alternative embodiment of the invention, wherein power source 16, inverter 20, and control switch 18, and their associated retention wall 60 are placed within a lower portion 64 of safety helmet 10 below a test line 66 as defined by the Snell Memorial Foundation Standards. Instead of placing the components above the wearer's head, positioning them below test line 66 may provide an added measure of safety and reduce the risk of injury to the wearer's head in the event of impact by an outside force with the helmet. Because of the thin space available in lower portion 64 of the helmet, in this embodiment it is particularly preferable to use flat coin cells as the power source for the light panel. Again, FIG. 8 shows three alternative locations for placing the components within the helmet. Also, as in the previous alternative embodiment, the components may be molded as one unit for ease of manufacturing and reducing costs.

In yet another alternative embodiment of the invention as shown in FIG. 9, power source 16, inverter 20, and control switch 18, may be assembled in one unit. One or more light panels 14 may be connected to the unit by wire leads 40. The entire assembly may then be secured by a strap 68 to the outer surface of safety helmet 10 as an add-on accessory item. This alternative embodiment provides an affordable method of illuminating a safety helmet (made available as an after-market accessory) without changing its structural aspects.

Figure 6A:
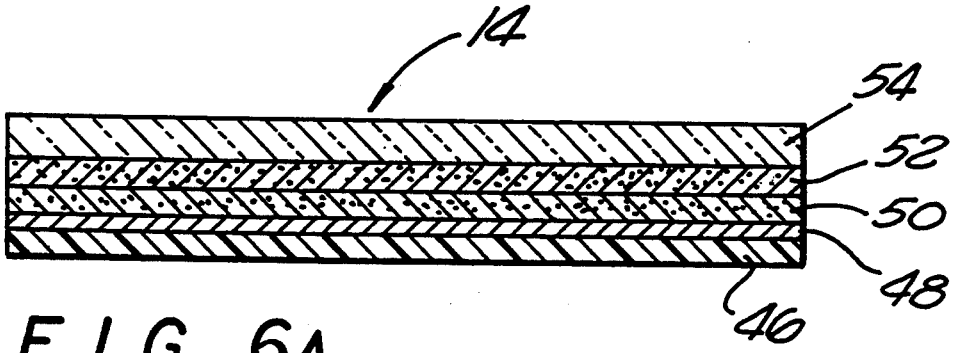

FIG. 6*a* illustrates illumination panel 14 which consists of various layers of elongated strips of material disposed one on top of another in a laminated structure. Rear insulator layer 46 is a flat surface which can be made of plastic or polyester substrate. A rear electrode layer 48 which is made of a metallic or otherwise electrically conductive material (preferably made of a Silver Oxide layer) is printed or otherwise disposed on rear insulator layer 46. A dielectric layer 50 is disposed on top of rear electrode layer 48 so as to provide a nonconducting layer of material for the purpose of providing a neutral substrate for a phosphor layer 52 and for maintaining an electric field with a minimum dissipation of power. Phosphor layer 52 is next disposed or printed (preferably by screen printing) on top of dielectric layer 50. Depending upon the particular phosphor chosen, various colors such as white, yellow, green, or blue may be emitted by phosphor layer 52. A transparent front electrode layer 54 formed of a polyester substrate (preferably Indium Tin Oxide) is disposed on phosphor layer 52. As will be explained below, rear electrode layer 48 and transparent front electrode layer 54 provide an electric field around phosphor layer 52 to excite the phosphor, thereby resulting in luminescence. The illumination panel shown in FIG. 6*a* does not have reflective capabilities.

Figure 6B:
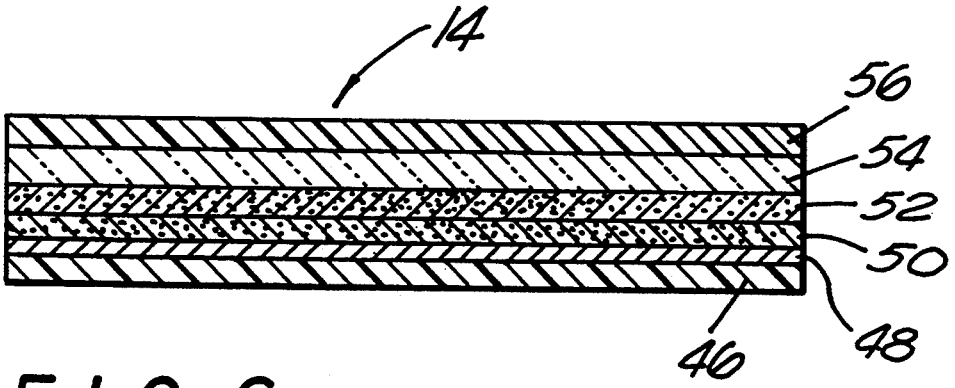

If desired, as shown in FIG. 6*b*, the reflective quality of panel 14 is achieved by having a transparent reflective film layer 56 disposed on transparent front electrode layer 54. Reflective film layer 56 reflects light coming from a light source such as a flashlight, street light, or automobile headlight, and at the same time allows the electroluminescence of phosphor layer 52 to be visible to an observer. In the present invention, the reflective function is totally independent and does not interfere with the electroluminescent function of panel 14.

All of the above-mentioned layers 46, 48, 50, 52, 54, and 56 can be laminated by various methods such as heat bonding or use of adhesives as long as the chosen method does not interfere with the operation of panel 14. If an adhesive is used to bond the various layers, there are certain criteria that must be followed in choosing a proper adhesive. Specifically, the adhesive used between rear electrode layer 48 and dielectric layer 50, between dielectric layer 50 and phosphor layer 52, and between phosphor layer 52 and transparent front electrode layer 54 must be electrically conductive. Also, the adhesive used between phosphor layer 52 and transparent front electrode layer 54, and between transparent front electrode layer 54 and transparent reflective film layer 56 must be transparent.

The electroluminescence of panel 14 is achieved by providing alternating current to rear electrode layer 48 and transparent front electrode layer 54. For this purpose, as shown in FIG. 5, power source 16 connected to inverter 20 with the output of inverter 20 being directed to rear and front electrode layers 48 and 54. Presently, electroluminescent panels are designed to operate on AC power, and use of DC power is not practical. Therefore, power source 16 is preferably a DC power source such as a battery, and inverter 20 is preferably a DC to AC inverter for changing the output of DC power source 16 to AC power before directing the power to panel 14. If, however, electroluminescent panels using direct current become practical, a DC to AC inverter will not be necessary, and power source 16 could be a DC power source with its output connected to rear and front electrode layers 48 and 54.

Control switch 18 is placed between power source 16 and inverter 20 in order to allow the user of panel 14 to turn the electroluminescent function to ON or OFF positions. Control switch 18 may be a two-position ON/OFF switch, a dimmer switch, a switch capable of causing on and off flashing, a remote control switch, or any other control switch that may cause the desirable effect. Control switch 18 may also be a manually operated switch or an automatic switch that has been preprogrammed to activate and deactivate panel 14 in response to certain conditions such as the onset of darkness.

As can be appreciated, the present invention adds a new useful feature to conventional safety helmets; i.e., the ability to provide an electroluminescent light source to produce highly visible cool light as well as having an optional reflective capability that does not interfere with the electroluminescence of the light source. Some of the advantages of an illumination system as described above are that it is light weight, thin, durable, reliable, flexible, and conformable to various shapes. Incorporating such an illumination system into helmets substantially improves their visibility and safety. Such an illumination system also provides a novelty item and a means for conveying an easily visible message in the form of a design logo or written information on helmets which can be easily used on helmets to promote brand awareness. While a particular form of the invention has been illustrated and described, it will also be apparent that various modifications can be made to the present invention without departing from the spirit and scope thereof.

What is claimed is:

1. An electroluminescent and light reflective safety helmet for protecting the head of a wearer, said helmet comprising:

a protective helmet wall having an interior surface and an exterior surface, said interior surface adapted to fit the head of the wearer;

a multi-layer panel having a phosphor layer for emitting electroluminescent light and a transparent reflective layer for reflecting incoming light, said panel secured to said protective helmet wall so as to be visible from said exterior surface of said protective helmet wall;

a power source associated with said helmet, said power source connected to said electroluminescent multi-layer panel to thereby excite said phosphor layer for emitting electroluminescent light;

power source housing for containing said power source mounted to said protective helmet wall, said power source housing having an interior side facing the head of the wearer; and a force distribution plate connected to said power source housing interior side, said force distribution plate having an interior side surface having a surface area greater than a corresponding area of said power source housing interior side, whereby a force of impact on said exterior surface of said protective helmet wall transmitted to said power source and said housing is transmitted to said greater surface area of said force distribution plate, to protect the head of the wearer from said impact.

2. The safety helmet of claim 1, wherein said power source is a DC power source.

3. The safety helmet of claim 2, wherein said DC power source is a battery.

4. The safety helmet of claim 2, further comprising a DC to AC inverter associated with said helmet, said inverter electrically connected between said DC power source and said multi-layer panel.

5. The safety helmet of claim 1, further comprising a control switch associated with said helmet, said control switch adapted to control the power from said power source to said multi-layer panel.

6. The safety helmet of claim 1, wherein said multi-layer panel is adhesively secured to said exterior surface of said helmet.

7. The electroluminescent and light reflective safety helmet of claim 1, wherein said force distribution plate and said power source housing are formed as one unit.

8. The electroluminescent and light reflective safety helmet of claim 4, further comprising an inverter housing for containing said inverter mounted to said protective helmet wall, said inverter housing having an interior side facing the head of the wearer; and an inverter force distribution plate connected to said inverter housing interior side, said inverter force distribution plate having an interior side surface having a surface area greater than a corresponding area of said inverter housing interior side, whereby a force of impact on said exterior surface of said protective helmet wall transmitted to said inverter and said housing is transmitted to said greater surface area of said inverter force distribution plate, to protect the head of the wearer from said impact.

9. The electroluminescent and light reflective safety helmet of claim 5, further comprising a control switch housing for containing said control switch mounted to said protective helmet wall, said control switch housing having an interior side facing the head of the wearer; and a control switch force distribution plate connected to said control switch housing interior side, said control switch force distribution plate having an interior side surface having a surface area greater than a corresponding area of said control switch housing interior side, whereby a force of impact on said exterior surface of said protective helmet wall transmitted to said control switch and said housing is transmitted to said greater surface area of said control switch force distribution plate, to protect the head of the wearer from said impact.

10. An electroluminescent safety helmet for protecting the head of a wearer, said helmet comprising:

a protective helmet wall having an interior surface and an exterior surface, said interior surface adapted to fit the head of the wearer;

a multi-layer panel having a phosphor layer for emitting electroluminescent light, said panel being secured to said protective helmet wall so as to be visible from said exterior surface of said protective helmet wall;

a power source associated with said helmet, said power source connected to said electroluminescent multi-layer panel to thereby excite said phosphor layer for emitting electroluminescent light;

a power source housing for containing said power source mounted to said interior surface of said protective helmet wall, said power source housing having an interior side facing the head of the wearer; and a force distribution plate connected to said power source housing interior side, said force distribution plate having an interior side surface having a surface area greater than a corresponding area of said power source housing interior side, whereby a force of impact on said exterior surface of said protective helmet wall transmitted to said power source and said housing is transmitted to said greater surface area of said force distribution plate, to protect the head of the wearer from said impact.

11. The electroluminescent safety helmet of claim 10, further comprising:

a DC to AC inverter associated with said helmet, said inverter electrically connected between said DC power source and said multi-layer panel;

an inverter housing for containing said inverter mounted to said protective helmet wall, said inverter housing having an interior side facing the head of the wearer; and an inverter force distribution plate connected to said inverter housing interior side, said inverter force distribution plate having an interior side surface having a surface area greater than a corresponding area of said inverter housing interior side, whereby a force of impact on said exterior surface of said protective helmet wall transmitted to said inverter and said housing is transmitted to said greater surface area of said inverter force distribution plate, to protect the head of the wearer from said impact.

12. The electroluminescent safety helmet of claim 10, further comprising:

a control switch associated with said helmet, said control switch being adapted to control the power from said power source to said multi-layer panel;

a control switch housing for containing said control switch mounted to said protective helmet wall, said control switch housing having an interior side facing the head of the wearer; and a control switch force distribution plate connected to said control switch housing interior side, said control switch force distribution plate having an interior side surface having a surface area greater than a corresponding area of said control switch housing interior side, whereby a force of impact on said exterior surface of said protective helmet wall transmitted to said control switch and said housing is transmitted to said greater surface area of said control switch force distribution plate, to protect the head of the wearer from said impact.

* * * * *